US009919818B2

(12) United States Patent
Geiger et al.

(10) Patent No.: US 9,919,818 B2
(45) Date of Patent: Mar. 20, 2018

(54) METHOD FOR CLOSING A COLLECTING TANK

(71) Applicant: MAHLE International GmbH, Stuttgart (DE)

(72) Inventors: Wolfgang Geiger, Ludwigsburg (DE); Dieter Gross, Stuttgart (DE); Thomas Herzig, Leonberg (DE); Boris Kerler, Stuttgart (DE); Kai Mille, Bucha (DE)

(73) Assignee: MAHLE International GmbH, Stuttgart (DE)

( * ) Notice: Subject to any disclaimer, the term of this patent is extended or adjusted under 35 U.S.C. 154(b) by 161 days.

(21) Appl. No.: 14/281,167

(22) Filed: May 19, 2014

(65) Prior Publication Data

US 2014/0251580 A1 Sep. 11, 2014

Related U.S. Application Data

(63) Continuation of application No. PCT/EP2012/072902, filed on Nov. 16, 2012.

(30) Foreign Application Priority Data

Nov. 17, 2011 (DE) ..... 10 2011 086 605

(51) Int. Cl.
*B65B 7/28* (2006.01)
*F28D 1/04* (2006.01)
(Continued)

(52) U.S. Cl.
CPC ..... *B65B 7/285* (2013.01); *B65B 3/04* (2013.01); *F28D 1/0461* (2013.01);
(Continued)

(58) Field of Classification Search
CPC .... F28D 1/0461; F28D 1/05383; F28D 20/02; B65B 7/285; B65B 3/04; F28F 2275/025
(Continued)

(56) References Cited

U.S. PATENT DOCUMENTS 4,006,775 A 2/1977 Avrea
4,098,328 A 7/1978 Cheong
(Continued)

FOREIGN PATENT DOCUMENTS

DE 76 03 161 U 6/1976
DE 44 20 366 A1 12/1995
(Continued)

OTHER PUBLICATIONS

Chinese Office Action for Chinese Application No. 201280056401.8 dated Oct. 10, 2015, with English translation.

*Primary Examiner* — Grant Moubry
*Assistant Examiner* — Raheen R Malik
(74) *Attorney, Agent, or Firm* — Muncy, Geissler, Olds & Lowe, P.C.

(57) ABSTRACT

A method for closing a fillable collecting tank, in particular a fillable collecting tank of a heat exchanger for storing a fluid, having walls forming the collecting tank, wherein one of the walls is formed as a baseplate having openings for receiving pipes, wherein a filling opening for adding the fluid is provided in one of the walls, wherein the filling opening can be closed by the provision of a closure element that can be inserted into the filling opening or can be placed onto the filling opening after the fluid has been added to the collecting tank. A heat exchanger is also provided.

13 Claims, 11 Drawing Sheets

(51) Int. Cl.
*F28D 1/053* (2006.01)
*B65B 3/04* (2006.01)
*F28D 20/02* (2006.01)

(52) U.S. Cl.
CPC ..... *F28D 1/05383* (2013.01); *F28D 20/02* (2013.01); *F28F 2275/025* (2013.01)

(58) Field of Classification Search
USPC ..... 165/96, 104.26; 29/890.032; 62/524
See application file for complete search history.

(56) References Cited

U.S. PATENT DOCUMENTS 4,659,268 A * 4/1987 Del Mundo ..... F16B 19/04 411/34
4,744,505 A * 5/1988 Calleson ..... B21D 39/06 165/173
5,044,852 A * 9/1991 Sweeney ..... F16B 47/00 248/205.3
5,356,735 A * 10/1994 Meadows ..... H01M 2/0242 429/120
6,324,759 B1 12/2001 Sasano et al.
6,854,513 B2 2/2005 Shirota et al.
6,868,597 B2 * 3/2005 Stevenson ..... F16B 3/005 29/460
7,017,255 B2 * 3/2006 Wang ..... F16B 5/00 29/458
7,841,386 B2 * 11/2010 Wang ..... F28D 15/0283 165/104.21
8,464,550 B2 6/2013 Kerler et al.
8,495,894 B2 * 7/2013 Kerler ..... F28D 1/05391 165/10
2009/0025419 A1 * 1/2009 Kerler ..... F25B 39/022 62/524
2009/0095015 A1 * 4/2009 Kerler ..... F28D 1/05391 62/524
2009/0178784 A1 * 7/2009 Wang ..... B23P 15/26 165/104.26
2010/0116474 A1 * 5/2010 Kerler ..... F25B 39/022 165/148
2010/0300655 A1 * 12/2010 Liu ..... F28D 15/0283 165/104.26
2010/0326586 A1 * 12/2010 Moeglich ..... B29C 65/082 156/73.3
2011/0024037 A1 * 2/2011 Becnel ..... B21D 53/02 156/295
2011/0048763 A1 * 3/2011 Schloms ..... B23K 20/10 174/90
2012/0285662 A1 * 11/2012 Meyer, IV ..... F28D 15/0283 165/104.26
2014/0065451 A1 * 3/2014 Fuhr ..... H01M 2/1235 429/56

FOREIGN PATENT DOCUMENTS

DE 100 13 746 A1 10/2000
DE 101 24 757 A1 11/2001
DE 10 2004 052 979 A1 5/2006
DE 10 2006 011 327 A1 9/2007
DE 10 2006 051 865 A1 5/2008
FR 2 799 825 A1 4/2001
JP 2006-022992 A 1/2006
WO WO 2007/133052 A1 11/2007

* cited by examiner

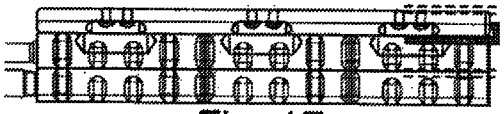
Fig. 17a
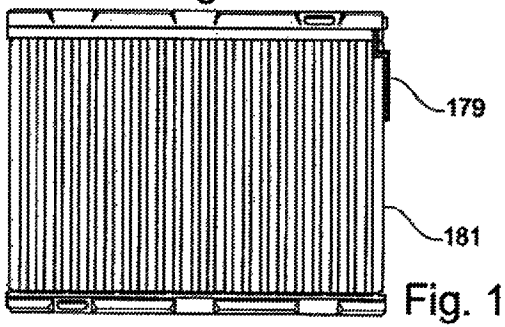
Fig. 17b
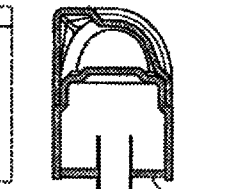
Fig. 17c
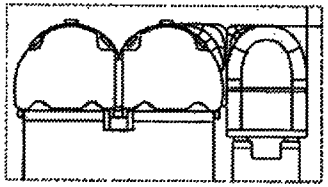
Fig. 17d
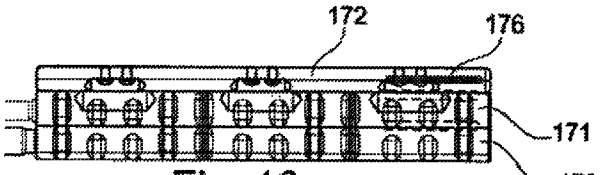
Fig. 16a
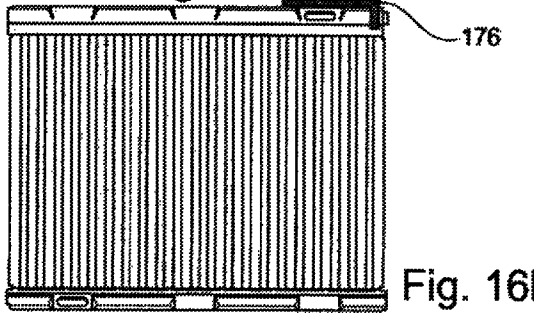
Fig. 16b
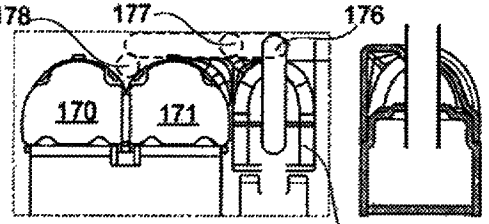
Fig. 16c
Fig. 16d

METHOD FOR CLOSING A COLLECTING TANK

This nonprovisional application is a continuation of International Application No. PCT/EP2012/072902, which was filed on Nov. 16, 2012, and which claims priority to German Patent Application No. DE 10 2011 086 605.1, which was filed in Germany on Nov. 17, 2011, and which are both herein incorporated by reference.

BACKGROUND OF THE INVENTION

Field of the Invention

The present invention relates to a method for closing a fillable collecting tank, particularly a fillable collecting tank of a heat exchanger for storing a fluid. Furthermore, the invention also relates to a heat exchanger.

Description of the Background Art

Collecting tanks of heat exchangers are used for the intake, distribution, storage, and/or discharge of media. In this regard, collecting tanks are used in the conventional art, which are provided with a connecting piece and can be closed with a screw-on and thereby removable plastic cover.

Other heat exchangers are connected by means of the provided connecting pieces to tubes or pipes, so that sealing of the collecting tank is therefore unnecessary.

Other collecting tanks are provided with valves which are closed after filling. This is not suitable for large-scale use, however, because it is very involved and costly.

SUMMARY OF THE INVENTION

It is therefore an object of the present invention to provide a method by which the filling opening of a heat exchanger can be closed securely and easily.

In an embodiment of the present invention, a method for closing a fillable collecting tank is provided, particularly a fillable collecting tank of a heat exchanger for storing a fluid, with walls forming the collecting tank, whereby one of the walls is formed as a baseplate having openings for receiving tubes, whereby a filling opening for adding the fluid is provided in one of the walls, whereby the filling opening can be closed by the provision of a closing element that can be inserted into the filling opening or placed on the filling opening after the fluid has been added to the collecting tank. It is expedient in this regard, if the closing element is inserted or attached only after the filling, in order to facilitate the handling of the closing and without the indispensable use of costly components.

The closing element can be a deformable closing element. This confers the advantage that the deformable closing element is inserted in the non-deformed state in the filling opening or is placed on said opening, before a deformation process brings about the sealing of the filling opening.

The filling opening can be closed directly by the deformation of the deformable closing element. This is advantageous, because by using the deformable closing element directly in the filling opening a small and easily manageable and convenient closing element can be employed.

The deformable closing element can be inserted in the filling opening and is deformed in the filling opening or in the immediate vicinity of the filling opening to seal the filling opening.

The deformable closing element can be placed in, at, or on the filling opening and the closing element is deformed at a distance from the filling opening in order to close the collecting tank fluid-tight. This has the advantage that a sealing closing of the filling opening can occur away from the actual filling opening.

The closing element can be a tube-like element that at one of its ends can be connected to the filling opening and is closed in a region spaced apart from this end. In this regard, the tube-like element is closed by deformation. The end of the tube or a region adjacent to the end can be deformed by such a squeezing or coiling process so that it is sealed thereby.

The opening after the closing can be sealed or made tight in addition via a sealing component, also called a sealant. It is advantageous in this regard if the sealing component is an adhesive. The adhesive or sealing compent in general can be applied to the closing element, such as, for example, deposited or spread or sprayed on. Depending on the selected flowability of the adhesive or sealing component, it can run over the closing element and close possible gaps and provide additional sealing of the sealing site.

The closing element can be a substantially planar element placed on the filling opening. To this end, it is advantageous if the substantially planar element abuts the collecting tank at the edge of the filling opening around the filling opening and is connected sealingly there.

The planar element can be a metal sheet made of aluminum or an aluminum alloy.

The element can be attached to the collecting tank by means of welding.

The welding can be by ultrasonic torsional welding or ultrasonic longitudinal welding. A very locally limited welding is achieved thereby.

In an embodiment, a heat exchanger can be provided with at least one fillable collecting tank, particularly for storing a fluid, with walls forming the collecting tank, whereby one of the walls is formed as a baseplate having openings for receiving tubes, whereby a filling opening for adding the fluid is provided in one of the walls, whereby the filling opening is closed with a deformable closing element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 16*a* is a schematic illustration of a heat exchanger from above with an angled filling tube;

FIG. 16*b* is a schematic illustration of a heat exchanger from the side with an angled filling tube;

FIG. 16*c* is a schematic illustration of a heat exchanger from the narrow side with an angled filling tube;

FIG. 16*d* is a schematic illustration of a heat exchanger from the narrow side with an angled filling tube;

FIG. 17*a* is a schematic illustration of a heat exchanger from above with an angled filling tube;

FIG. 17*b* is a schematic illustration of a heat exchanger from the side with an angled filling tube;

FIG. 17*c* is a schematic illustration of a heat exchanger from the narrow side with an angled filling tube;

FIG. 17*d* is a schematic illustration of a heat exchanger from the narrow side with an angled filling tube;

DETAILED DESCRIPTION

Figure 2:
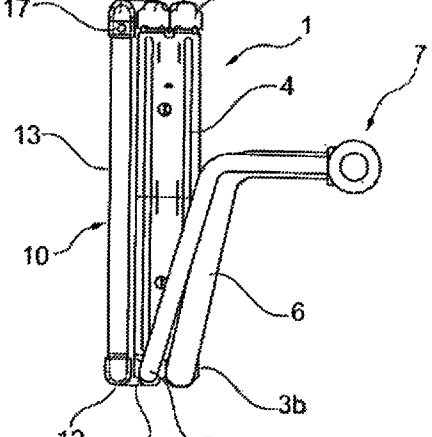
FIG. 2 is a heat exchanger in a side view.
Figure 1:
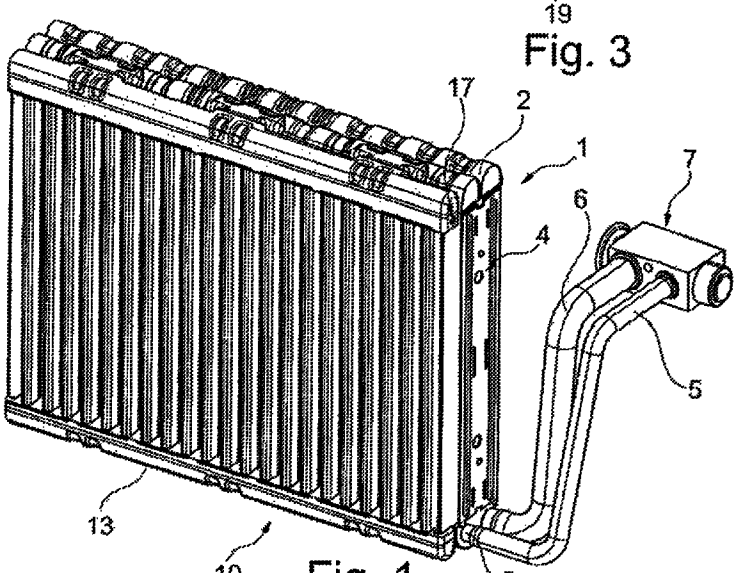
FIG. 1 is a heat exchanger in a perspective view according to an embodiment.

FIGS. 1 and 2 show a heat exchanger 1 in a perspective view or in a side view, respectively. In this case, heat exchanger 1 has a first collecting tank 2 and a second collecting tank 3, which are each arranged on the two opposite ends of a tube-fin block 4. Heat exchanger 1 with tube-fin block 4 is designed as dual-flow in a first region; this means that inlet tube 5 leads into collecting tank 3; next a medium flows from collecting tank 3 to collecting tank 2 through the tube-fin block in region 2*a*, flows over from region 2*a* to region 2*b*, then flows from collecting tank 2 to collecting tank 3 in region 3*b* through the tube-fin block, and flows out again through outlet tube 6. An expansion valve 7 is connected to the end regions of the tubes at the two ends of tubes 5 and 6, said ends being opposite to heat exchanger 1.

Heat exchanger 1 further has a region 10, which is arranged adjacent to the heat exchanger region with collecting tanks 2 and 3 and tube-fin block 4. Region 10 of the heat exchanger comprises a collecting tank 11 and a collecting tank 12 and a tube-fin block 13, whereby tube-fin block 13 is equipped with coaxially arranged heat exchanger tubes, so that a first fluid can flow in the interior of the inner tube and a second fluid can flow in the interspace between the inner tube and the outer tube. Collector 11 or collector 12 is designed such here that they have a first collecting space 14 and a second collecting space 15, whereby first collecting space 14 preferably communicates with the interior of the inner tube and collecting space 15 communicates with the interspace between the inner tube and the outer tube. The two collecting spaces 14 and 15 are arranged in a collecting tank and separated from one another by a partition wall 16. It is preferred now that collecting space 14 is connected via a fluid communication line to collecting tank 2 and the opposite collecting space 14, located at the lower end, of collecting tank 12 is in fluid communication with collecting tank 3. This has the effect that a fluid, which in the region of the inlet flows out of outlet tube 5 into collector 3, on the one hand, can flow through tube-fin block 4 to collector 2 or, on the other, alternatively can flow from collector 3 into collector 12. From there, the fluid would flow from collector 12 through the inner tube of the coaxial tube into collector 11 and from there would flow into collector 2 before the medium again flows back to collector 5 and leaves heat exchanger 1 from outlet tube 6.

The design therefore creates more or less a triple-flow heat exchanger 1, in which two flows are connected parallel and these are then connected in series to a third flow. Moreover, a further heat exchanger is located in region 10, whereby a fluid, which can be collected and provided via collecting tanks 15 of upper collecting tank 11 and lower collecting tank 12, can be provided in the tube regions between the inner tube and outer tube of region 10.

In a preferred embodiment of the invention, heat exchanger 1 is a coolant evaporator, in which coolant flows in through the inlet tube, flows through the described fluid channels and collecting tanks through the heat exchanger, and then again leaves the heat exchanger at the outlet tube. The region of the additional heat exchanger in region 10 can be provided as a storage medium region, where a latent cold storage medium can be provided that is cooled during the operation of the evaporator based on the heat given off to the coolant, and in the case of an air flow with a turned-off evaporator function in a stationary coolant circuit the air can then be cooled by uptake of energy or enthalpy from the air.

The heat exchanger for the so-called accumulator region 10 is basically separated from the heat exchanger region of the evaporator for the flow of coolant fluid and is also not in fluid communication with the inlet or outlet tube 5, 6. There is a separation of media between the coolant and the cold storage medium.

Figure 3:
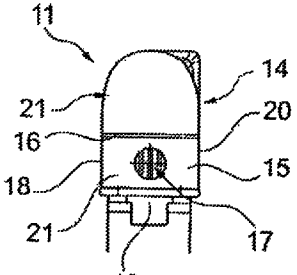
FIG. 3 is a side view of the collecting tank of the heat exchanger according to FIG. 1 and FIG. 2.

Collecting space 15 of collecting tank 14 has an opening 17 for filling the heat exchanger, such as particularly the accumulator region of the heat exchanger; said opening can be easily seen in FIG. 3 and is arranged on a narrow side of collector 11. In this regard, collector 11 is formed by walls 18, 19, 20, 16, and 21, whereby collecting space 15 is formed by walls 18, 19, 20, and 16. Front wall 21 is part of the walls forming the collecting tank and incorporates opening 17 as a filling opening. The fluid to be added to heat exchanger 1 is added through said filling opening 17 and after the filling, filling opening 17 is closed by means of a closing element which is not shown.

The basic design and connection of such a so-called storage evaporator according to FIGS. 1 to 3 are disclosed in the publication DE 10 2006 051 865 A1 or in DE 10 2004 052 979 A1, which are both herein incorporated by reference.

Figure 4:
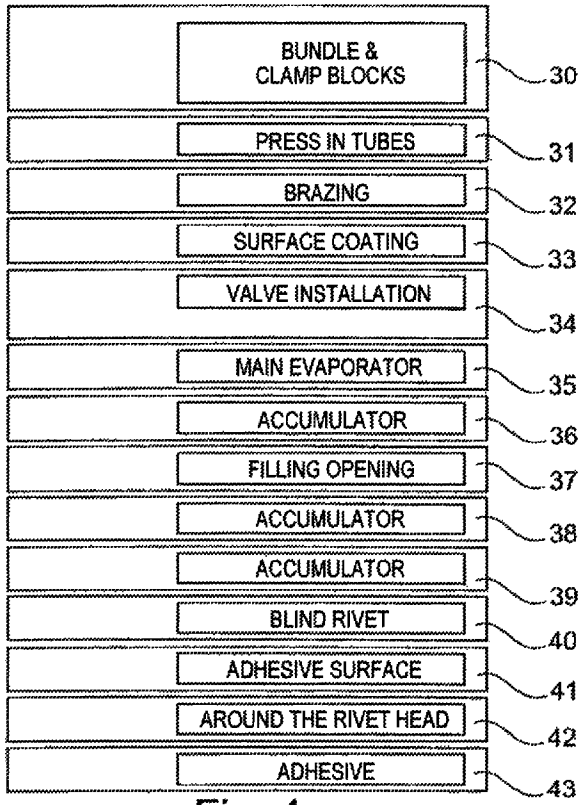
FIG. 4 is a block diagram for explaining a process for the production of a heat exchanger.

The production of a heat exchanger occurs by the processes being described now, whereby a process is used for the production of the evaporator resulting in the evaporator as such. The building of the evaporator in this regard according to FIG. 4 begins with a provision of parts necessary for the assembly of the evaporator, such as the collector sheets for the tubes and fins and the connecting tubes, etc. Next, the relevant parts are fitted together to form the heat exchanger. In FIG. 4, this occurs in block 30 in that the building of the evaporator is begun with the bundling of the tube-fin blocks and clamping of said tube-fin blocks. Next, the thus bundled tubes are pressed at their ends into the tube base of the collecting tank, see block 31. This is also called the tube installation.

The now fully assembled heat exchanger where connecting tubes 5, 6 can also be already connected, is then brazed in the brazing furnace, see block 32. An optional surface coating occurs in block 33 after the brazing process. In block 34, expansion valve 7 is then installed in inlet and outlet tubes 5, 6, according to FIG. 1 or 2, see block 34. After production of heat exchanger 1 and the valve installation, the main evaporator, also called the evaporator section of the heat exchanger, is tested according to block 35, as well as the accumulator section 36 of the heat exchanger. Next, the region of filling opening 17 is cleaned, see block 37. After this, the accumulator is evacuated, see block 38, and then in block 39 the accumulator section is filled with a medium by means of a filling device.

Reference is made to the aforementioned publications DE 10 2006 051 865 A1 and DE 10 2004 052 979 A1 in regard to the filling process.

Next, after the filling the filling opening is closed by means of a closing element. According to block 40, a deformable closing element such as, for example, a blind rivet is used advantageously here, which is inserted in filling opening 17 of FIGS. 1 to 3 and then deformed. Subsequently, in block 41, the surface to be sealed, also called the adhesive surface in FIG. 4, undergoes a cleaning process. The cleaning process can be a mechanical cleaning process or a chemical cleaning process. In block 42 the head of the rivet or closing element is then sealed with a sealing component such as, for example, an adhesive, whereby in block 43 the curing process of the sealing component or of the adhesive can be accelerated by applying UV radiation or some other radiation that accelerates curing.

Figure 5:
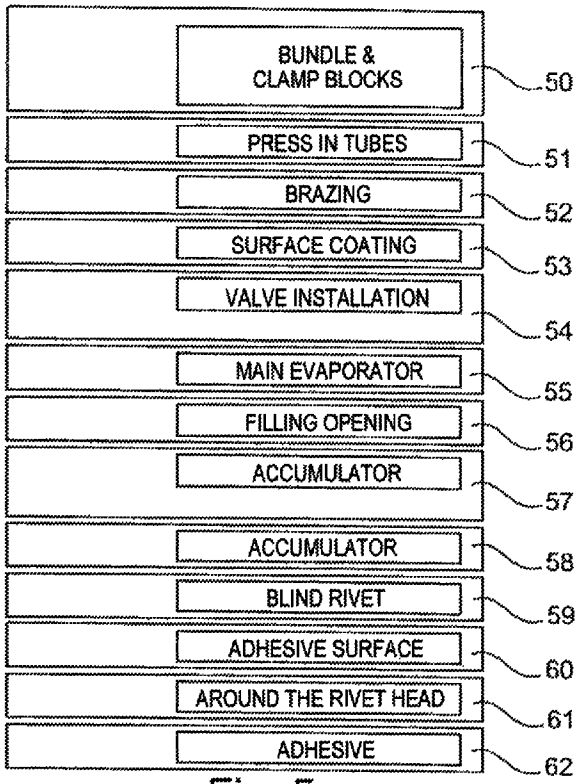
FIG. 5 is a block diagram for explaining a process for the production of a heat exchanger.

A block diagram in FIG. 5 shows an alternative approach, whereby in block 50 the block is bundled and then clamped and thereby the evaporator construction is begun. Next, in block 51 the tube ends of the tubes are pressed into the openings of the tube bases of the collecting tanks, also called tube installation. Thereafter, in block 52 the heat exchanger is brazed. This occurs preferably during passage through a brazing furnace.

After the brazing of the heat exchanger, an optional surface coating can be undertaken, see block 53. Next, the provided valve, in the case of the evaporator the expansion valve, is connected to the substantially finished heat exchanger, according to block 54. In block 55, leak testing of the main evaporator takes place and in block 56 the surface regions, to be sealed later, of the filling opening or the surface regions adjacent thereto are cleaned. Next, the accumulator section of the heat exchanger is also tested for leaks according to block 57. Preferably, in this process step the evacuation of the accumulator section of the heat exchanger may also be carried out, since the filling process is facilitated by an evacuation. The filling of the accumulator section is provided in block 58 of FIG. 5. Next, in block 59 the filling opening is closed by means of a deformable closing element such as, for example, a blind rivet. In block 60, the surface to be sealed, also called the adhesive surface, is cleaned. In block 61, the surface to be sealed, preferably also the surface around the rivet head, is sealed and in block 62 curing of the sealing component or of the adhesive occurs, preferably by means of irradiation with UV rays.

Figures 6A, 6B, 6C, 6D, 6E, 6F:
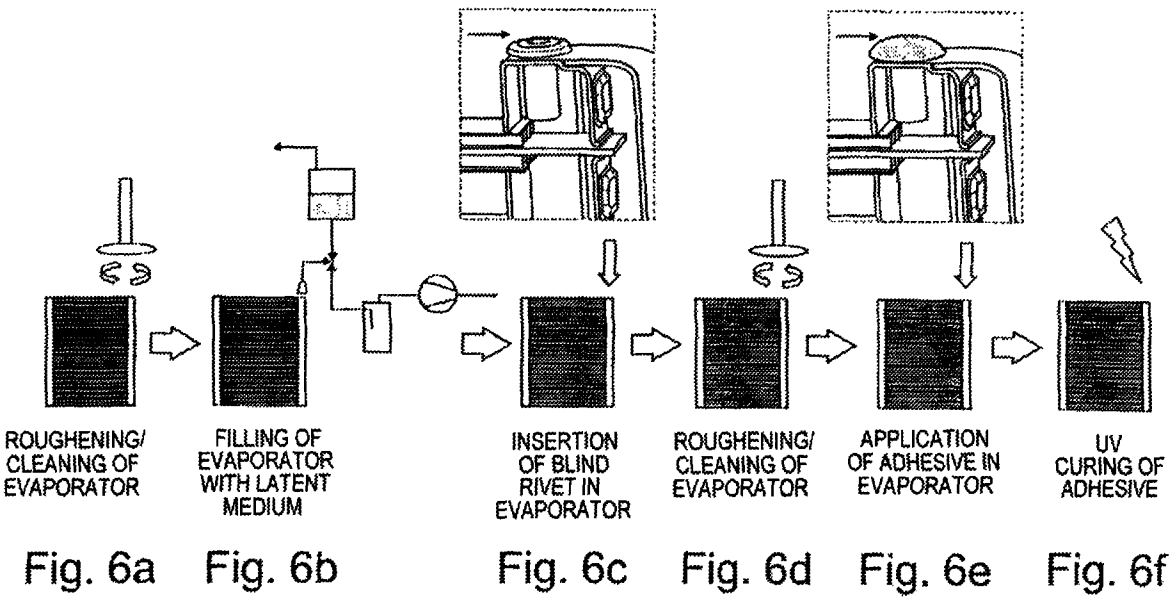
FIG. 6*a* is a schematic illustration for the roughening and/or cleaning of a filling opening to be closed.
FIG. 6*b* is a schematic illustration for filling an accumulator section of an evaporator.
FIG. 6*c* is a schematic illustration for inserting a closing element.
FIG. 6*d* is a schematic illustration for the roughening and/or cleaning of a filling opening to be closed.
FIG. 6*e* is a schematic illustration for applying a sealing component, such as an adhesive.
FIG. 6*f* is a schematic illustration for the curing of the sealing component.

FIG. 6, in six sub-FIGS. 6*a* to 6*f*, shows the process of filling and closing the heat exchanger, particularly for the accumulator section of the storage evaporator.

FIG. 6*a* shows that the filling area, such as particularly the filling opening, is cleaned or roughened by means of a cleaning element or a roughening element. Next, in FIG. 6*b* a filling device is connected to the filling opening and the accumulator section of the evaporator is evacuated and then a latent storage medium is sucked in from a storage reservoir by the low pressure into the accumulator section of the evaporator. As a result, the accumulator section of the evaporator is filled with the latent storage medium. In FIG. 6*c*, a closing element, preferably a blind rivet, is inserted in the filling opening. It can be seen in the top detail of FIG. 6*c* how a sleeve-like blind rivet element is inserted as a closing element into the filling opening. FIG. 6*d* shows that the region of the closing element head or the region arranged around it is roughened or cleaned. This occurs again as in FIG. 6*a* by means of a roughening or cleaning device. It can be seen in FIG. 6*e* that the head of the closing element is sealed by means of a sealing component such as, for example, by means of an adhesive. The final sealing of gaps still remaining after the deformation of the closing element is thereby accomplished. In FIG. 6*f*, radiation is applied causing the accelerated curing of the sealing component, such as the adhesive.

It is especially preferred, if the closing of the filling opening occurs with a deformable closing element such as, for example, a blind rivet, with the diameter of the blind rivet being preferably between 5 and 15 mm. The use of a blind rivet provides sufficient mechanical strength of a rivet shaft length of about 3 to 10 mm. The rivet can be inserted in the closing opening preferably manually or also power-assisted such as, for example, pneumatically. A subsequent degreasing or roughening of the surface in the hole vicinity of the closing opening leads to better adhesion of the sealing component to be applied later, such as, for example, an adhesive. This also serves in particular as removal of flux residues by mechanical removal or by plasma treatment or by a chemical surface treatment.

The application of the sealing component, such as particularly the adhesive, in the area of the closing element, such as the rivet head, may prevent the escape of the latent storage medium. The transition from the closing element, such as, for example, the rivet head, to the surface region of the wall of the collector, preferably must be completely covered, with the sealing layer being preferably about 1 mm and extending beyond the edge. The optimal layer thickness of the adhesive or of the sealing component is 1 to 5 mm. An anaerobically curing adhesive is preferred in this case used such as, for example, Wellomer UV 4601. The adhesive can be applied manually or with a dosing pump.

The UV curing of the adhesive, for example, via a UV point source or a UV flood lamp, can preferably be used. The UV radiation dose is preferably set so that the adhesive on the surface is cured within about 10 seconds and in its entire depth within about 30 seconds. The optimal distance with such a point source of radiation is about 20 to 200 mm, whereby preferably 100 mm is set. The size of the point source of radiation can correspond approximately to the diameter of the applied surface region of the sealing component or of the adhesive drop, whereby an exhaust can also be provided to catch emerging solvent vapors of the adhesive or of the sealing component, so that these vapors are removed. It is preferred if the sealing component or the adhesive is post-cured anaerobically for about another 24 hours after the curing before installation in a climate control device.

The use of a deformable closing element, here, for example, a blind rivet, and the subsequent application of a sealing component, here, for example, as an adhesive, produce a sufficiently high mechanical strength and simultaneously reliable sealing against the escape of a relatively odor-intensive latent storage medium. This process is especially preferable because of a good integrability into a series process environment with short cycle times, whereby the possibility of leak testing and evacuation for filling can also be achieved in one process.

In case the closing element protrudes relative to the wall of the collecting tank and spreads the adhesive layer, only minor adjustments are necessary regarding the installation space within the climate control device. Usually this is easily accomplished, so that the above-described approach represents a preferred approach without causing major changes in the climate control device.

Figure 8:
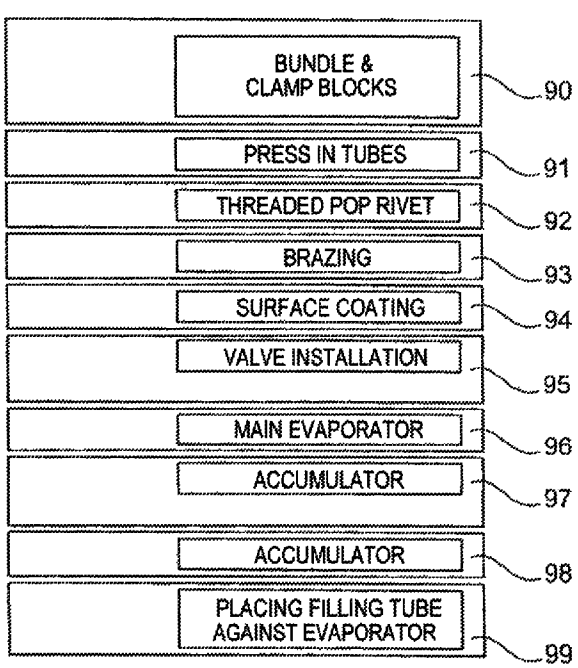
FIG. 8 is a block diagram for explaining a process for the production of a heat exchanger according to an embodiment.
Figure 7:
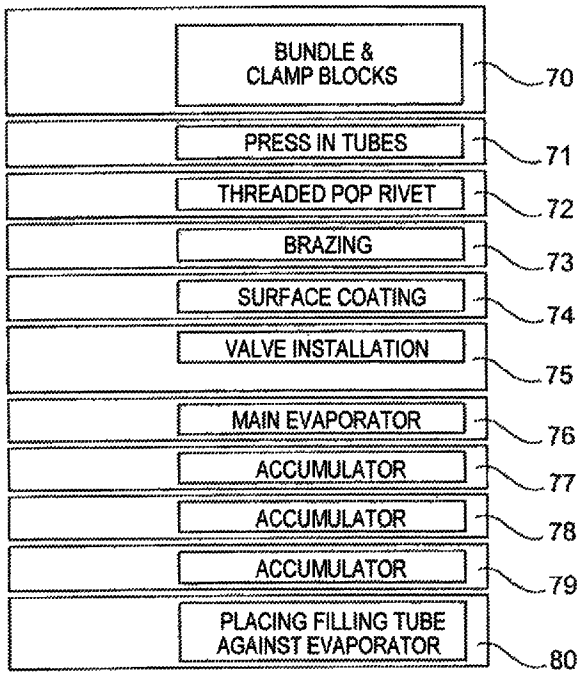
FIG. 7 is a block diagram for explaining a process for the production of a heat exchanger according to an embodiment.

FIGS. 7 and 8 together with FIGS. 9*a* to 9*d* show a further alternative embodiment of the method of the invention for closing a filling opening of a heat exchanger.

A method is described in FIG. 7, in which in block 70 the tube-fin blocks of the heat exchanger are bundled and clamped. It represents the first essential step for building the evaporator. The tube installation is carried out in block 71, whereby in this region the ends of the tubes are pressed into the openings in the tube bases. Next, in block 72 a threaded pop rivet is inserted in the filling opening of the collecting tank. In block 73, the thus assembled heat exchanger is brazed in a brazing furnace and in block 74 preferably a surface coating is provided on the heat exchanger. Next, in block 76 a leak test is performed on the main evaporator section through which the coolant can flow and then in block 77 the accumulator section of the heat exchanger can be leak-tested. Next or simultaneously, the accumulator section of the heat exchanger can be evacuated, see block 78, and filled in block 79. Next, closing of the filling opening occurs by insertion of a screw in the deformable closing part, such as the threaded pop rivet.

FIG. 8 shows an alternative approach, whereby in block 90 the the evaporator construction is carried out in that the blocks are bundled and clamped. The tube installation occurs in block 91 whereby the tube ends of the tubes are pushed and pressed into the provided openings or passages in the tube base; see block 91 in this regard. Next, a threaded pop rivet is inserted into the filling opening of the collecting tank and deformed, whereby in block 93 the heat exchanger is brazed. In block 94, an optional surface coating is provided, whereby in block 95 a valve installation can be provided for installing the expansion valve. Next, leak testing of the main evaporator takes place according to block 96, and leak testing and evacuation of the accumulator section of the evaporator according to block 97. In block 98, the accumulator section is filled and in block 99 the filling opening is closed. Preferably a screw is inserted into the pop rivet element.

Figure 9A:
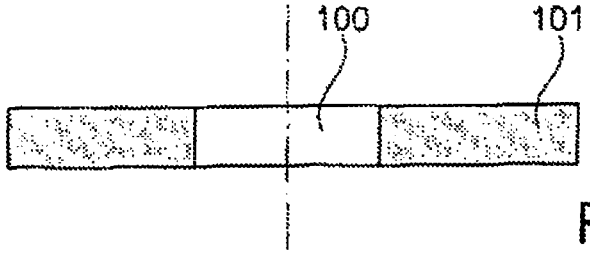
FIG. 9*a* is a schematic illustration of a filling opening.

FIG. 9*a* shows in section the region of filling opening 100 in the region of the collecting tank wall 101 in the accumulator section of the heat exchanger. A bored hole in the wall of the collector is visible, which is not yet provided with a closure, however.

Figure 9B:
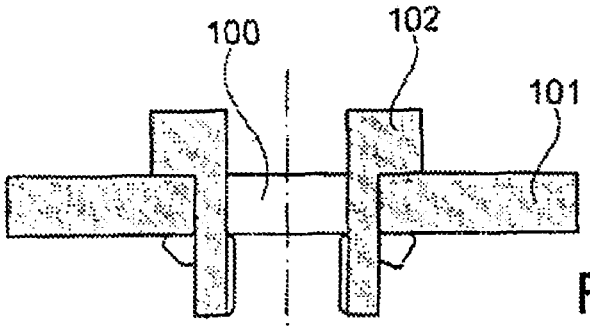
FIG. 9*b* is a schematic illustration of a filling opening with rivet.
Figure 9C:
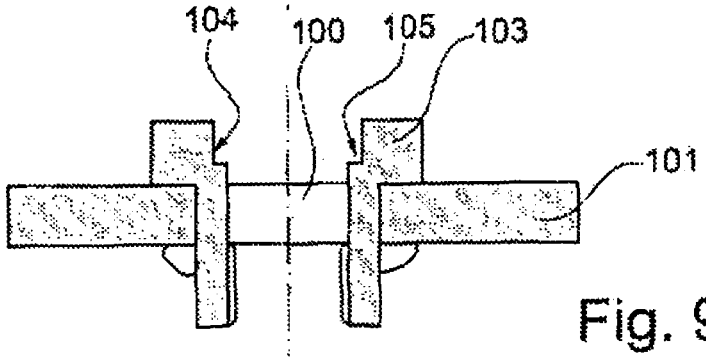
FIG. 9*c* is a schematic illustration of a filling opening with rivet.

In FIG. 9*b* it can be recognized how a deformable element 102, as, for example, a pop rivet with an internal thread, is provided in the opening 100 in wall 101. This pop rivet can be fitted to the opening preferably by deformation. In so doing, the deformation can be provided either in the pop rivet itself or in wall 101 in which the opening is provided. In FIG. 9*c*, an alternative embodiment of pop rivet 103 is shown which is inserted in opening 100 of wall 101, whereby shoulder 105 is provided on inner wall 104; said shoulder is used as a shoulder for countersinking an insertable screw head.

Figure 9D:
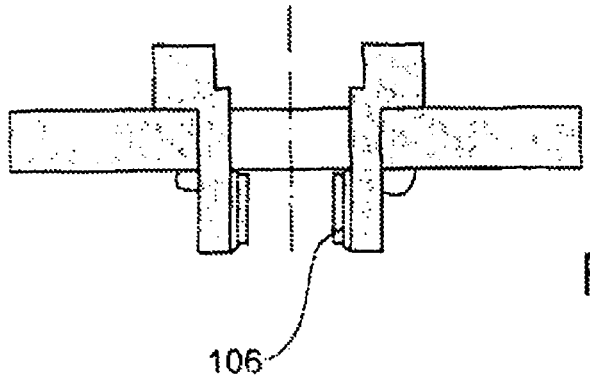
FIG. 9*d* is a schematic illustration of a filling opening with rivet.
Figure 10A:
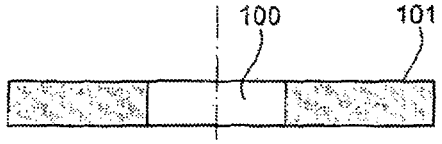
FIG. 10*a* is a schematic illustration of a filling opening.
Figure 10B:
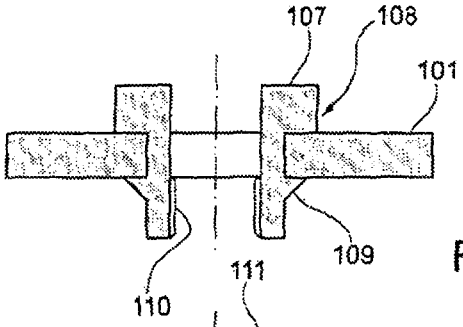
FIG. 10*b* is a schematic illustration of a filling opening with rivet.
Figure 10C:
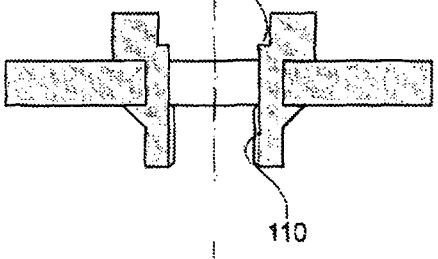
FIG. 10*c* is a schematic illustration of a filling opening with rivet.
Figure 10D:
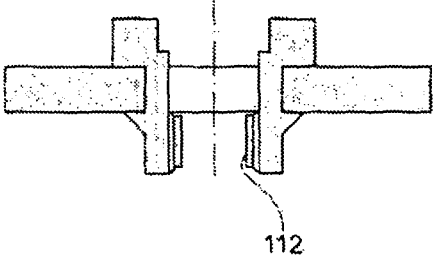
FIG. 10*d* is a schematic illustration of a filling opening with rivet.

In FIG. 9*d*, in contrast to FIG. 9*c*, a sealing element 106 is furthermore provided, which, for example, can be a Teflon band, and is used for sealing the screw-in screw that can be inserted into the pop rivet.

The alternative solution according to FIGS. 7 to 9*d* provides that according to a standardized evaporator construction, the filling opening is next made by means of a pop rivet with an internal thread that is inserted into the bored hole of the collector. In this case, for a slight projection over the evaporator width of about 0 to 3 mm, it can be provided that the screw in the pop rivet may be made as countersinkable, see FIG. 9*c*. After insertion of the pop rivet, said pop rivet with its central bored hole can then be sealed by a screw. It can be advantageous in this case that the thread can be provided in addition with a sealing element 106, for example, with a Teflon band or a Teflon coating, so that the screw is securely sealed relative to the thread and a latent medium escape from the collector can thereby be prevented long-term and permanently. The use of self-sealing screws or threaded elements is also conceivable.

FIGS. 10*a* to 10*d* show an alternative design of the rivet element in a filling opening 100 of a wall 101. In this case, rivet elements 107 is formed such that it has a shoulder 108 on the outside of the wall and a deformable element 109 on the inside, providing a form-fitting connection of the element with wall 101 (see FIG. 10*b*). Subsequently, in thread 110, within the central opening of the rivet element a thread and a screw can be screwed in to seal the opening. In this case, according to FIG. 10*c* a shoulder 111 can also be provided in the rivet element to receive a screw head within the rivet element. Further, according to FIG. 10*d* a sealing element 112, such as preferably a Teflon band, can also be provided to better seal the insert of the screw.

Figure 12:
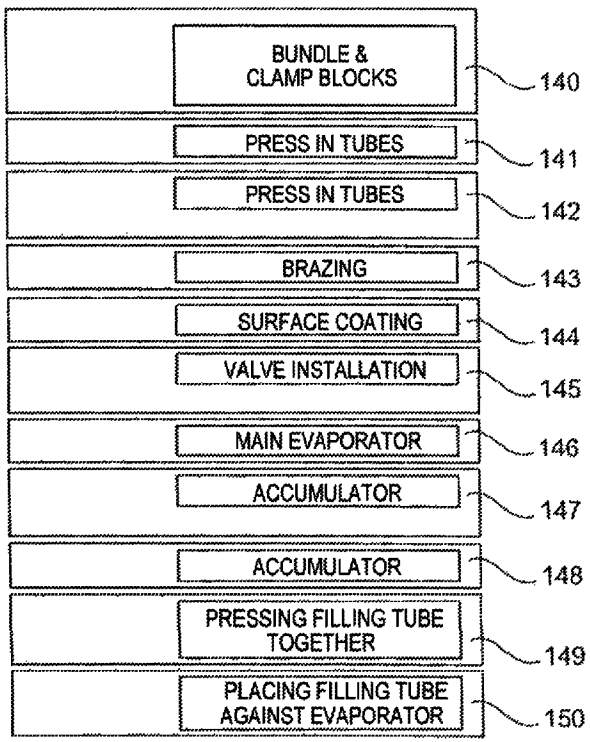
FIG. 12 is a block diagram for explaining a process for the production of a heat exchanger according to an embodiment.
Figure 11:
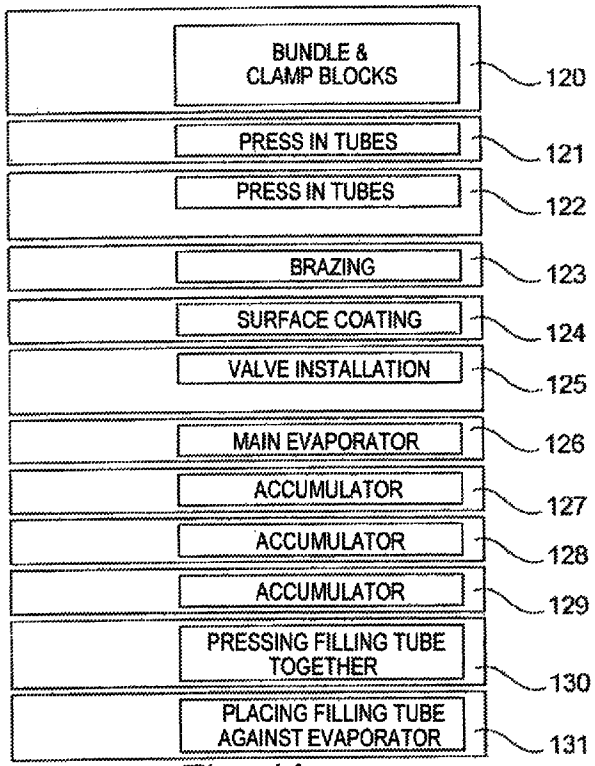
FIG. 11 is a block diagram for explaining a process for the production of a heat exchanger according to an embodiment.

FIGS. 11 and 12 describe a method in which a filling tube placed on the filling opening is closed after the filling by deformation.

In this case, a corresponding method is described in FIG. 11, whereby in block 120 the building of the evaporator occurs by bundling of the tube-fin blocks and the clamping of these blocks. In block 121, tube installation occurs by pushing or pressing of the tube ends into the openings of the tube bases. Next, the filling tube is installed, see block 122. In so doing, the filling tube is pressed into an opening provided for this or alternatively pressed onto a bond provided for this. In block 123, the thus assembled heat exchanger is brazed. In block 124, an optional surface treatment or surface coating takes place, whereby as in block 125 a valve installation, for example, an expansion valve, takes place. In block 126, the evaporator section of the heat exchanger, also called the main evaporator, is tested for leaks. In block 127, the sealing testing of the accumulator section of the evaporator takes place. In block 128, the accumulator section, which is filled in block 129, is evacuated. In block 130, the accumulator section is closed by pressing together or deformation of the filling tube. In block 131, the filling tube is placed against the evaporator for adjustment of the outer contour, so that the filling tube does not unnecessarily produce a structural space due to a protruding tube.

An alternative method is described in FIG. 12, whereby in block 140 the evaporator is constructed by bundling and clamping of the tube-fin blocks. In block 141, tube installation occurs by pushing or pressing the tubes into the provided tube openings in the tube bases. In block 142, installation of the filling tube takes place whereby the filling tube is pressed into a provided opening or onto a provided connecting piece. In block 143, brazing in the furnace takes place and in block 144 an optional surface coating takes place, whereby in block 145 a valve, such as preferably an expansion valve, is mounted on the connecting tube. In block 146, the leak testing of the evaporator section takes place and in block 147 the leak testing and evacuation of the accumulator section of the evaporator takes place, whereby in block 148 the accumulator is filled with the medium, such as particularly the latent storage medium, whereby the accumulator section in block 149 is closed by pressing together or deformation of the filling tube. Next, again in block 150 the outer contour of the evaporator is adjusted by placement of the filling tube against it.

Figures 13A, 13B, 13C, 13D:
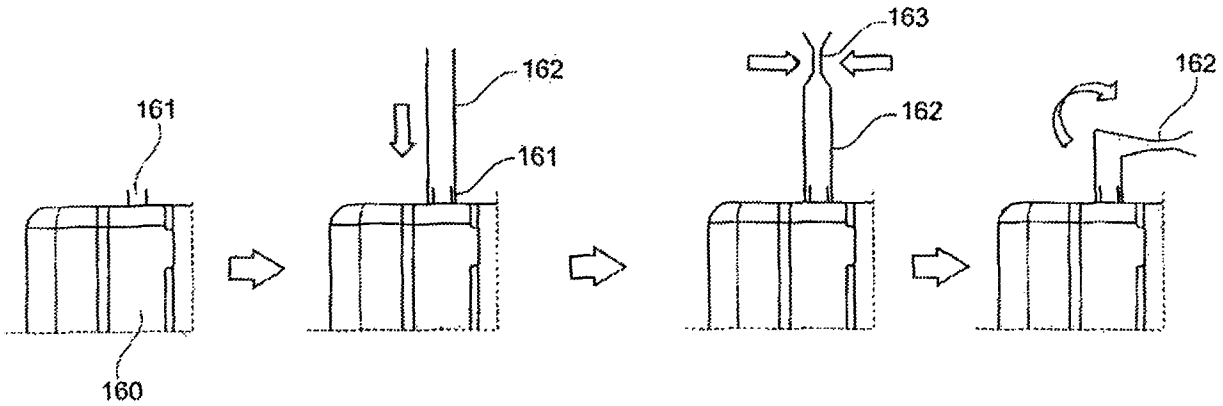
FIG. 13*a* is a schematic illustration of a filling opening.
FIG. 13*b* is a schematic illustration of a filling opening with a filling tube.
FIG. 13*c* is a schematic illustration of a filling opening with a closed filling tube.
FIG. 13*d* is a schematic illustration of a filling opening with an angled filling tube.
Figure 15A:
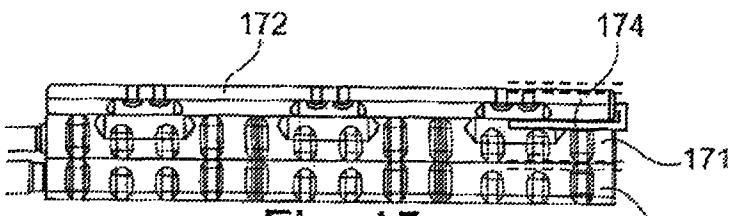
FIG. 15*a* is a schematic illustration of a heat exchanger from above with an angled filling tube.
Figure 15B:
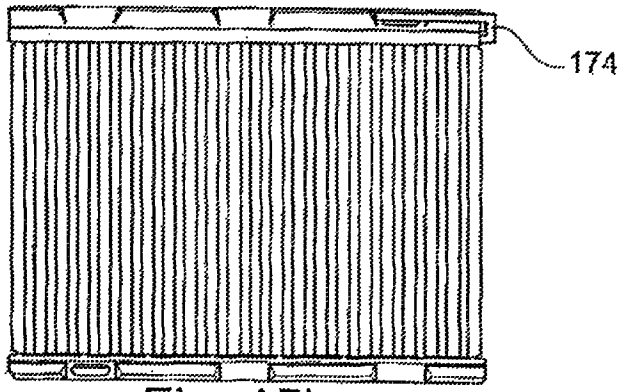
FIG. 15*b* is a schematic illustration of a heat exchanger from the side with an angled filling tube.
Figure 15C:
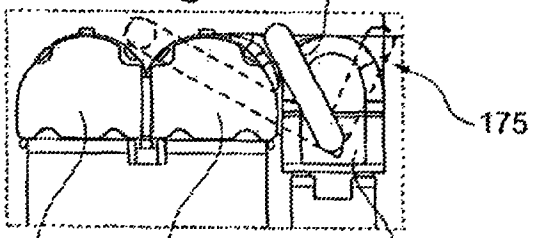
FIG. 15*c* is a schematic illustration of a heat exchanger from the narrow side with an angled filling tube.
Figure 14A:
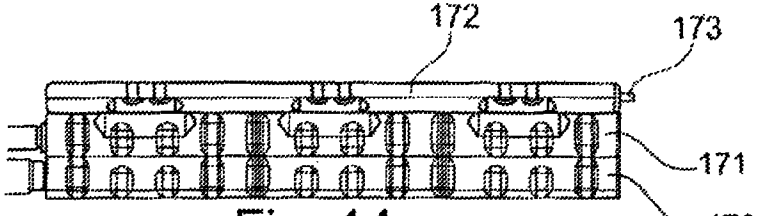
FIG. 14*a* is a schematic illustration of a heat exchanger from above with an angled filling tube.
Figure 14B:
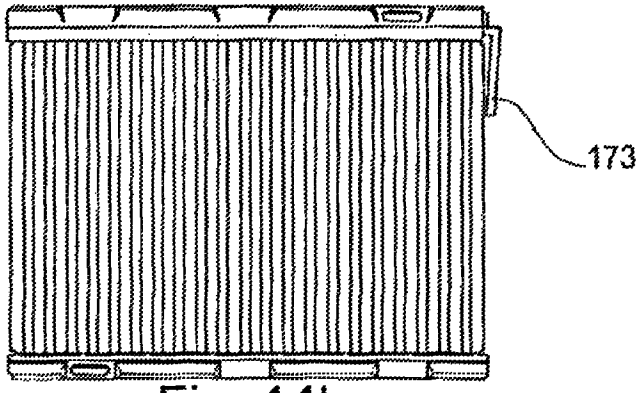
FIG. 14*b* is a schematic illustration of a heat exchanger from the side with an angled filling tube.
Figure 14C:
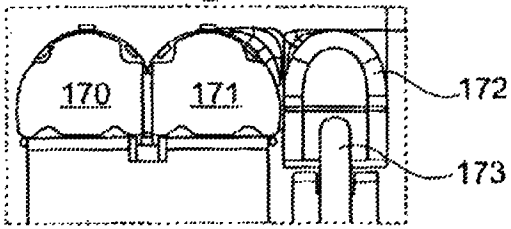
FIG. 14*c* is a schematic illustration of a heat exchanger from the narrow side with an angled filling tube.

FIGS. 13*a* to 13*d* show the connection of a filling tube with a collector of a heat exchanger, its closure, and its adaptation to the installation space conditions. In this case, in FIG. 13*a* collector 160 is formed with a pipe connection 161 connected to the collecting space for the preferably accumulator section of the evaporator. In FIG. 13*b*, filling tube 162 is pushed or pressed onto connecting piece 161, this configuration allowing the filling to occur via the filling tube. In FIG. 13*c*, filling tube 162 is deformed in region 163, for example, squeezed together, thereby closing the filling tube. In FIG. 13*d*, the filling tube is bent, so that it does not extend too far from the collecting tank of the evaporator and advantageously comes to abut a surface region of the evaporator. FIGS. 14*a* to 14*c*, FIGS. 15*a* to 15*c*, FIGS. 16*a* to 16*d*, and FIGS. 17*a* to 17*d* show arrangement variants for arranging a filling tube. FIG. 14*a*, viewed from above, thereby shows the heat exchanger of the invention, such as the evaporator with collecting tank 170, 171 of the evaporator section and tank 172 of the accumulator section of the evaporator. Filling tube 173 is arranged on an end side of collecting tank 172 of the evaporator section and, as can be seen in FIG. 14*b*, arranged angled downward parallel to the tubes of the tube-fin block. FIG. 14*c* shows this once again in a side view, whereby the filling tube communicates with the filling opening and is angled downward. FIG. 15*a* shows the same collectors 171, 170, and 172, whereby the filling tube is bent more or less U-shaped and is oriented parallel to the longitudinal extension of a collector. To this end, filling tube 174 is bent upwards and laterally more or less U-shaped between the collecting tanks and is arranged along the longitudinal axis of the collecting tanks. Different arrangement variants for filling tube 174 are shown in FIG. 15*c*. Thus, the filling tube can be arranged in principle in a filter-shaped recess between collectors 171 and 172; a recess is arranged between collectors 170 and 171 or in a position adjacent to collector 172, see arrow 175, whereby the filling tube in this exemplary embodiment is placed in a spatial area where the collector forms an arc and therefore does not require so much installation space. In the examples of FIGS. 16*a* to 16*d*, collectors 170, 171, and 172 are provided accordingly and the filling tube 176 is shown entering the collector from the side from the filling opening or from above, whereby the filling tube, angled in an I-shape, is oriented along the longitudinal direction of collector 172. Alternatively, the filling tube can also be arranged parallel to the collecting tanks in the delta-shaped spatial areas according to reference character 177 or 178.

FIGS. 17*a* to 17*d* show a variant in which the filling tube enters the collector from a bottom side of the tube base of the collecting tank, see FIG. 17*c*, where filling tube 179 enters the collector through a lower edge area 180. Accordingly, in a simplified design filling tube 179 can be oriented substantially perpendicular downward, so that it is oriented more or less parallel to side wall 181 of the collector and takes up as little space as possible. Viewed from above, according to FIG. 17*a*, this arrangement is advantageous such that the header cannot be seen.

Figure 19:
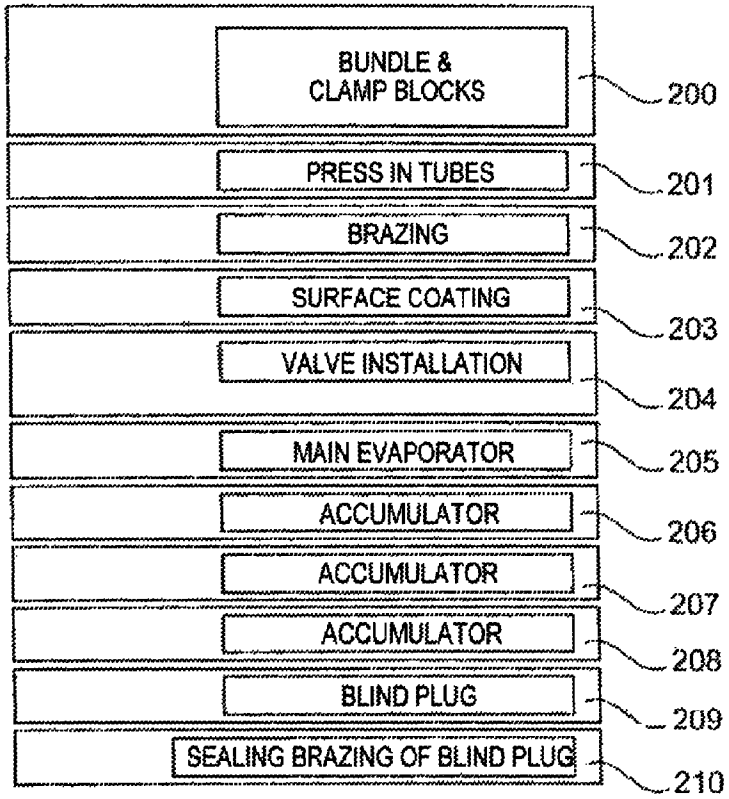
FIG. 19 is a block diagram for explaining a process for the production of a heat exchanger according to an embodiment.
Figure 18:
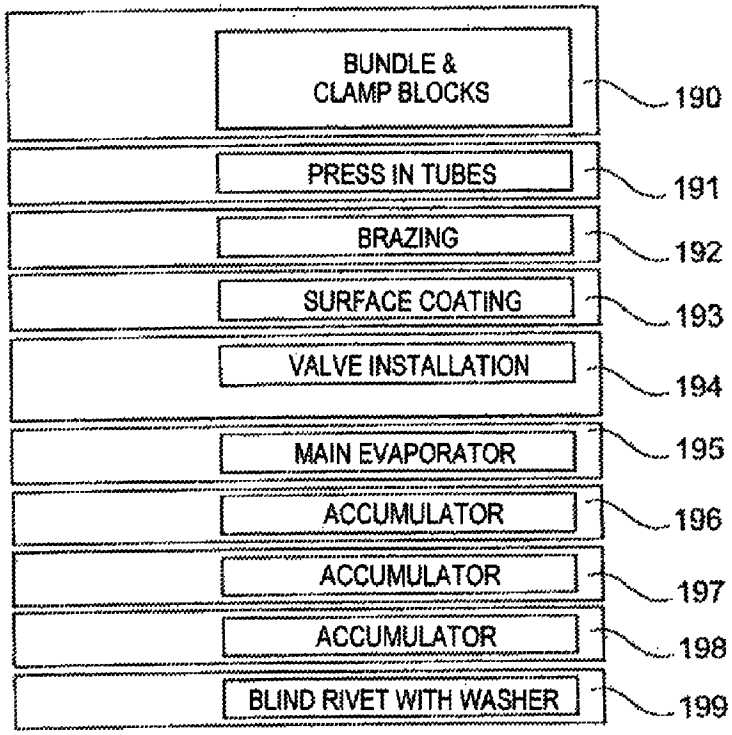
FIG. 18 is a block diagram for explaining a process for the production of a heat exchanger according to an embodiment.

FIGS. 18 and 19 show further approaches to the method of the invention for closing a filling opening of a collecting tank of a heat exchanger. In this regard, FIG. 18 in block 190 shows the construction of the evaporator by bundling and clamping of the tube-fin blocks. In block 191, tube installation takes place by pressing the tubes into the provided tube openings in the tube base. In block 192, the heat exchanger is brazed in the furnace, whereby in block 193 an optional surface coating can occur, before in block 194 a valve installation, for example, for the expansion valve, takes place. In block 195, the leak testing of the evaporator section of the heat exchanger takes place, whereby in block 196 the accumulator section of the heat exchanger is tested for leaks. Next, evacuation takes place in block 197 and filling of the accumulator in block 198, whereby in block 199 the filling opening is closed by a deformable element, such as, for example, a rivet element or a blind rivet element, optionally with a washer.

FIG. 19 shows the approach in an exemplary embodiment of a further method of the invention, whereby in block 200 the evaporator construction is characterized by bundling and clamping of the blocks. In block 201, tube installation takes place by pressing the tubes into the openings, provided for this, in the tube base. Brazing in the brazing furnace takes place in block 202 and an optional surface coating in block

203. In block 204, a valve installation can occur where, for example, an expansion valve is placed and connected at the provided connecting tube of the heat exchanger. Leak testing of the evaporator section of the heat exchanger takes place in block 205, whereby leak testing of the accumulator of the heat exchanger takes place in block 206, whereby an evacuation of the accumulator section takes place in block 207, so that filling of the accumulator section can occur in block 208. In block 209 a closing of the filling opening of the accumulator section occurs, for example, by a blind plug, which can then be sealed by post-brazing, see block 210.

In an alternative method, the closing element is a substantially planar element placed on the filling opening. It is then attached to the collecting tank by means of welding. In this case, the welding is an ultrasonic torsional welding or an ultrasonic longitudinal welding. The element is thereby placed on the collecting tank also preferably made of aluminum or an aluminum alloy and acted upon by means of a punch moving in the torsional direction or in the longitudinal direction, also called a sonotrode, and welded.

In this regard, the substantially planar element are a metal sheet made of aluminum or an aluminum alloy. It may be advantageous here for the metal sheet to have an indentation that engages in the opening.

Advantageously, the metal sheet has a material thickness of about 0.5 to 3 mm, preferably 1 mm.

An energy input is advantageously from about 400 to 750 Ws at a clock rate of 1 second or less. Clock rates are advantageously in the range of 0.2 to about 0.5 seconds. A welding power of up to 10 kW at a force application of up to 10 kN is advantageous thereby.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for closing a fillable collecting tank or a fillable collecting tank of a heat exchanger for storing a fluid, with walls forming the collecting tank, the method comprising:

forming one of the walls as a baseplate having openings for receiving tubes, providing a filling opening for adding the fluid in one of the walls; and closing the filling opening via a closing element that is insertable into the filling opening or placed on the filling opening after the fluid has been added to the collecting tank, wherein the opening is sealed after the closing via a sealing component, the sealing component entirely covering a head of the closing element and a portion of an outer surface of the one wall provided with the filling opening, such that the sealing component is provided on the outer surface of the one wall around the closing element.

2. The method according to claim 1, wherein the closing element is a deformable closing element.

3. The method according to claim 2, wherein the filling opening is closed directly by the deformation of the deformable closing element.

4. The method according to claim 3, wherein the deformable closing element is inserted in the filling opening and is deformed in the filling opening or in the immediate vicinity of the filling opening to seal the filling opening.

5. The method according to claim 2, wherein the deformable closing element is placed in, at, or on the filling opening and wherein the closing element is deformed at a distance from the filling opening in order to close the collecting tank fluid-tight.

6. The method according to claim 1, wherein the sealing component is an adhesive.

7. The method according to claim 1, wherein the closing element is a substantially planar element, which is placed on the filling opening.

8. The method according to claim 7, wherein the planar element is a metal sheet made of aluminum or an aluminum alloy.

9. The method according to claim 7, wherein the element is attached to the collecting tank via welding.

10. The method according to claim 9, wherein the welding is an ultrasonic torsional welding or an ultrasonic longitudinal welding.

11. A method for closing a fillable collecting tank or a fillable collecting tank of a heat exchanger for storing a fluid, with walls forming the collecting tank, the method comprising:

forming one of the walls as a baseplate having openings for receiving tubes, providing a filling opening for adding the fluid in one of the walls; and closing the filling opening via a closing element that is insertable into the filling opening or placed on the filling opening after the fluid has been added to the collecting tank, wherein the closing element is a deformable closing element, wherein the closing element is deformed at a distance from the filling opening in order to close the collecting tank fluid-tight, wherein the closing element is a hollow tube that is connected at a first end to the filling opening and that extends to a second end that is provided outside of the collecting tank and the hollow tube is closed in a region spaced apart from the filling opening, wherein the region of the hollow tube that is spaced apart from the filling opening is provided outside of the collecting tank and is positioned closer to the second end of the hollow tube than the first end of the hollow tube, wherein the hollow tube is closed by deforming sides of the hollow tube inward in a direction towards a central axis of the hollow tube in the region spaced apart from the filling opening, and wherein after the sides of the hollow tube are deformed inward in the region spaced apart from the filling opening, the hollow tube is bent to form a bend in the hollow tube.

12. A heat exchanger comprising:

at least one fillable collecting tank for storing a fluid, with walls forming the collecting tank, wherein one of the walls is formed as a baseplate having openings for receiving tubes, wherein a filling opening for adding the fluid is provided in one of the walls, wherein the filling opening is closed with a deformable closing element, and wherein a sealing component is provided, the sealing component entirely covering a head of the closing element and a portion of an outer surface of the one wall provided with the filling opening, such that the sealing component is provided on the outer surface of the one wall around the closing element.

13. The method according to claim 11, wherein the bend is provided at a second region of the hollow tube that is provided outside of the collecting tank and is between the filling opening and the region spaced apart from the filling opening that includes the deformed sides of the hollow tube.

* * * * *